US011324379B2

(12) United States Patent
Ross

(10) Patent No.: US 11,324,379 B2
(45) Date of Patent: May 10, 2022

(54) MOP WITH INTERCHANGEABLE HEAD MECHANISMS

(71) Applicant: Tylor Christian Ross, Edwardsburg, MI (US)

(72) Inventor: Tylor Christian Ross, Edwardsburg, MI (US)

( * ) Notice: Subject to any disclaimer, the term of this patent is extended or adjusted under 35 U.S.C. 154(b) by 0 days.

(21) Appl. No.: 17/129,892

(22) Filed: Dec. 21, 2020

(65) Prior Publication Data

US 2021/0186295 A1 Jun. 24, 2021

Related U.S. Application Data

(60) Provisional application No. 62/950,838, filed on Dec. 19, 2019.

(51) Int. Cl.

| | |
|---|---|
| ***A47L 13/144*** | (2006.01) |
| ***A47L 13/24*** | (2006.01) |
| ***A47L 13/12*** | (2006.01) |
| ***A47L 13/02*** | (2006.01) |
| ***A47L 13/11*** | (2006.01) |

(52) U.S. Cl.

CPC ..... *A47L 13/24* (2013.01); *A47L 13/02* (2013.01); *A47L 13/11* (2013.01); *A47L 13/12* (2013.01); *A47L 13/144* (2013.01)

(58) Field of Classification Search

CPC ..... A47L 13/24; A47L 13/02; A47L 13/11; A47L 13/144; A47L 13/12; A47L 13/14; A47L 13/142; A47L 13/257; A47L 13/258

See application file for complete search history.

(56) References Cited

U.S. PATENT DOCUMENTS 2,740,146 A * 4/1956 Vaughn ..... A47L 13/144 15/119.2
3,407,424 A * 10/1968 Lanzarone ..... B25G 1/04 15/145
6,260,226 B1 * 7/2001 Specht ..... A47L 13/144 15/119.1

(Continued)

FOREIGN PATENT DOCUMENTS

CN 107865620 A 4/2018
CN 108272411 A 7/2018

(Continued)

*Primary Examiner* — Shay Karls

(57) ABSTRACT

A mop with interchangeable head mechanism is an apparatus that facilitates the use of multiple mop heads with a single handlebar. The apparatus includes a handle shaft, an adapter neck, a retention bracket, at least one interchangeable head assembly, a first attachment mechanism, and a second attachment mechanism. The handle shaft allows a user to easily maneuver the at least one interchangeable head assembly from a distance. The adapter neck connects the retention bracket and the at least one interchangeable head assembly with the handle shaft. The retention bracket connects the at least one interchangeable head assembly with the adapter neck. The at least one interchangeable head assembly serves as the mop head. The first attachment mechanism locks and unlocks the handle shaft with the adapter neck. The second attachment mechanism locks and unlocks the at least one interchangeable head assembly with the retention bracket.

13 Claims, 8 Drawing Sheets

(56) References Cited

U.S. PATENT DOCUMENTS

| | | | | |
|---|---|---|---|---|
| 6,543,081 | B1 * | 4/2003 | Cohen | A47L 13/144 15/119.2 |
| 6,842,936 | B2 | 1/2005 | Policicchio | |
| 6,953,299 | B2 | 10/2005 | Wang | |
| 9,999,336 | B2 | 6/2018 | Zhu | |
| 2014/0310974 | A1 * | 10/2014 | Masquin | A47L 13/14 34/397 |
| 2019/0059681 | A1 * | 2/2019 | Weliver | A47L 13/252 |
| 2020/0196824 | A1 * | 6/2020 | He | A47L 13/146 |

FOREIGN PATENT DOCUMENTS

| | | | |
|---|---|---|---|
| CN | 108670141 | A | 10/2018 |
| CN | 109965800 | A | 7/2019 |
| CN | 111000506 | | 4/2020 |

* cited by examiner

MOP WITH INTERCHANGEABLE HEAD MECHANISMS

The current application claims a priority to the U.S. provisional patent application Ser. No. 62/950,838 filed on Dec. 19, 2019. The current application is filed on Dec. 21, 2020 while Dec. 19, 2020 was on a weekend.

FIELD OF THE INVENTION

The present invention generally relates to cleaning tools. More specifically, the present invention is a mop with interchangeable head mechanisms.

BACKGROUND OF THE INVENTION

In order to thoroughly and efficiently clean, the proper cleaning tools are required to tackle specific chores or messes. Cleaning tools, however, can cost money and take up plenty of storage space. Mops are cleaning tools that can easily cost money and require a large amount of space in storage. Such mops include flat mops, sponge mops, string mops, steam mops, spin mops, microfiber mops, and so on. In addition to the cleaning tools used to tackle a chore or mess, there are additional tools needed to rinse and clean the cleaning tools for effective use.

It is therefore an objective of the present invention to provide a universal mop that may be used to address various chores or messes. The present invention is a mop with an interchangeable head mechanism. The present invention provides a single handlebar with multiple mop heads. The present invention provides a full range of maneuverability for the handlebar and the mop head in order to efficiently address a chore or mess. The present invention facilitates the cleaning of each mop head and interchanging of mop heads. Furthermore, each mop head may be easily cleaned between uses as the present invention provides a wringer mechanism that is mountable onto the handlebar.

DETAIL DESCRIPTIONS OF THE INVENTION

All illustrations of the drawings are for the purpose of describing selected versions of the present invention and are not intended to limit the scope of the present invention.

Figure 1:
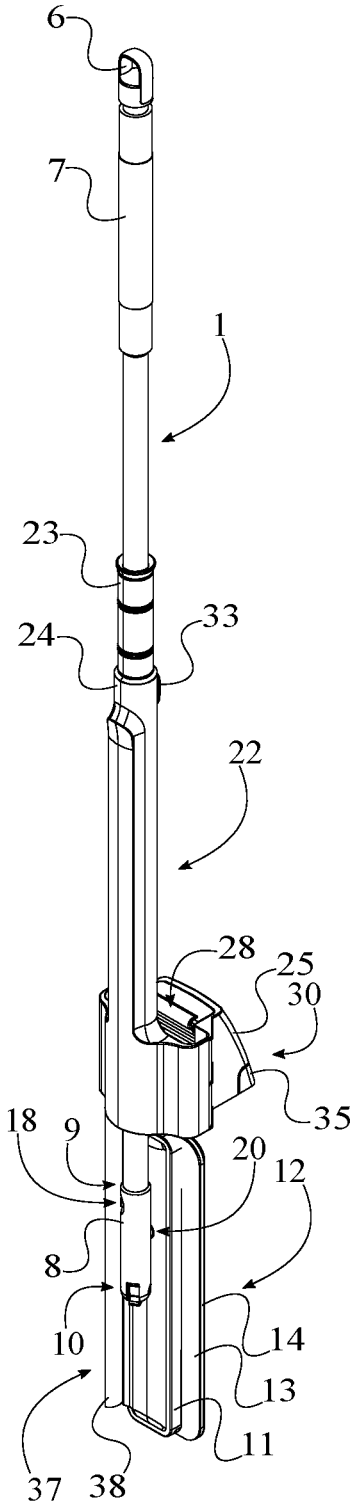
FIG. 1 is a top-front perspective view of the present invention.
Figure 2:
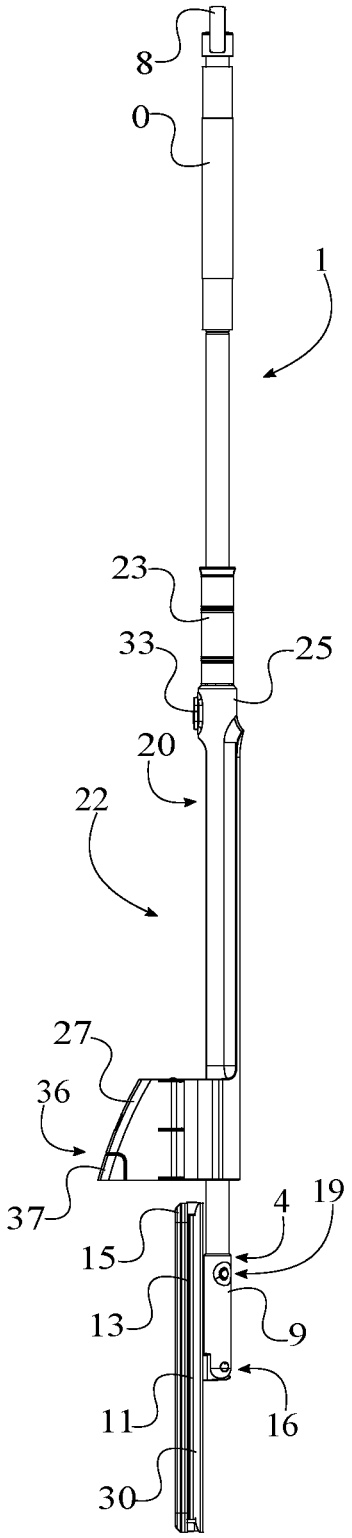
FIG. 2 is a side view of the present invention.
Figure 3:
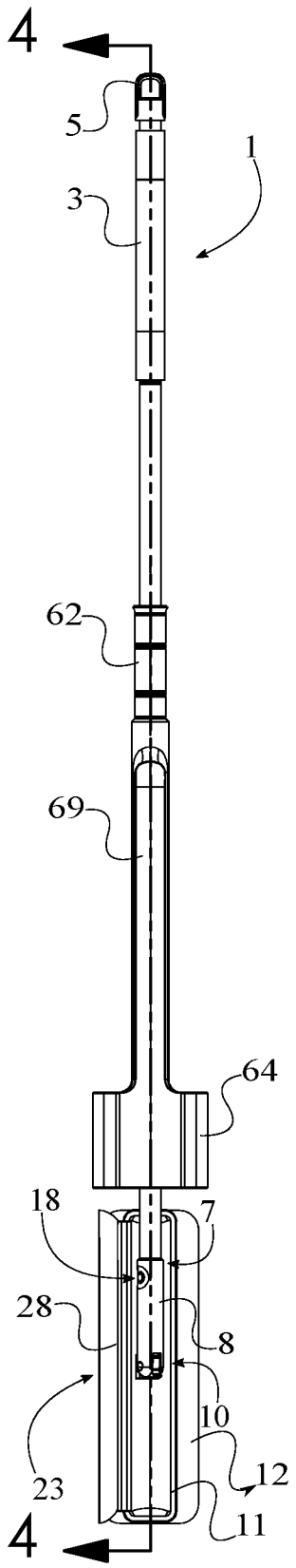
FIG. 3 is a front view of the present invention.

The present invention is a mop with interchangeable head mechanisms. The present invention serves as a universal cleaning tool that facilitates the attachment of various mop heads with a single handlebar. The present invention therefore requires less storage space and allows for quick and easy cleaning of mop heads. In order for the present invention to provide such versatility, the present invention may comprise a handle shaft 1, an adapter neck 8, a retention bracket 11, at least one interchangeable head assembly 12, a first attachment mechanism 18, and a second attachment mechanism 20, seen in FIG. 1. The handle shaft 1 serves as the handlebar for the present invention so that a user may maneuver the at least one interchangeable head assembly 12 from a distance. The handle shaft 1 comprises a first shaft and a second shaft end 3. The first shaft end 2 is the portion of the handle shaft 1 that a user grips, and the second shaft end 3 is the portion of the handle shaft 1 that connects with the adapter neck 8. Alternatively, the handle shaft 1 may be telescopic to better maneuver the at least one interchangeable head assembly 12 for different types of chores and messes. The adapter neck 8 connects the retention bracket 11 and the at least one interchangeable head assembly 12 with the second shaft end 3. In order to easily attach and detach the adapter neck 8 with the handle shaft 1, the adapter neck 8 comprises an open neck end 9 and a closed neck end 10. The open neck end 9 receives the handle shaft 1, and the closed neck end 10 connects with the retention bracket 11. The at least one interchangeable head assembly 12 serves as the mop head 14. More specifically, the at least one interchangeable head assembly 12 may be, but is not limited to, a flat mop, a sponge mop, a dust mop, a string mop, and a microfiber mop. In an alternate embodiment of the present invention, the at least one interchangeable head assembly 12 may be handheld as well for cleaning surfaces such as windows for example. The at least one interchangeable head assembly 12 comprises a base plate 13 and a mop head 14. The base plate 13 mounts the body of the mop head 14 and connects the mop head 14 with the retention bracket 11. The mop head 14 may comprise materials such as microfiber, cotton, scrubbing materials with various degrees of abrasiveness, polyvinyl alcohol, cellulose sponge, and so on, in order to effectively clean a given surface. The first attachment mechanism 18 attaches and detaches the adapter neck 8 with the handle shaft 1, and the second attachment mechanism 20 attaches and detaches the base plate 13 of the at least one interchangeable head assembly 12 with the retention bracket 11.

The overall configuration of the aforementioned components facilitates the engagement of various types of mop heads. The handle shaft 1 may be used to clean the floor or reach high surface as the first shaft end 2 is positioned opposite the second shaft end 3 along the handle shaft 1, seen in FIG. 1 and FIG. 4. A user easily maneuvers the present invention across a surface as the retention bracket 11 is positioned adjacent with the closed neck end 10 and is hingedly connected with the closed neck end 10. This arrangement allows the user to pivot the at least one interchangeable head assembly 12 about the handle shaft 1. The entire bottom portion of the present invention may be separated from the handle shaft 1 for cleaning as the second shaft end 3 is releasably mounted into the open neck end 9 by the first attachment mechanism 18. The base plate 13 is positioned adjacent with the retention bracket 11, opposite the adapter neck 8, and is releasably mounted across the retention bracket 11 by the second attachment mechanism 20. The at least one interchangeable head assembly 12 is therefore easily switched for another interchangeable head assembly with a different mop head 14. The mop head 14 is positioned adjacent with the base plate 13, opposite the retention bracket 11 in order for the mop head 14 to come into contact with a surface. Moreover, the mop head 14 is mounted across the base plate 13, preventing the base plate 13 from being damaged while in use and allowing the user to effectively press the mop head 14 against a surface.

Figure 4:
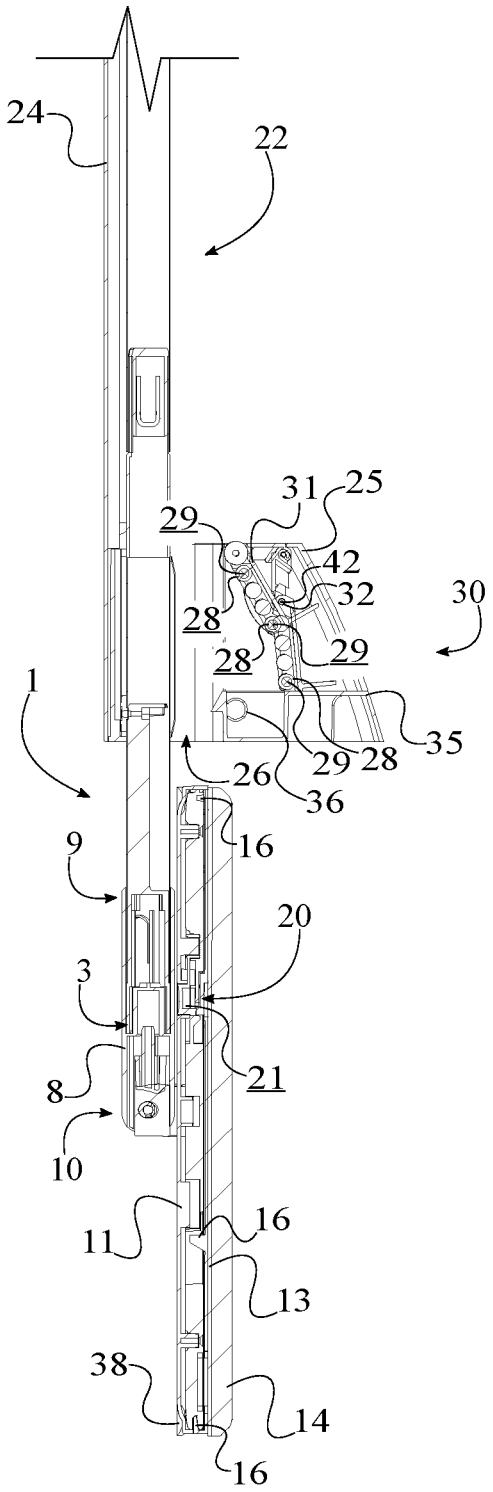
FIG. 4 is a bottom portion cross-section view taken along line 4-4 in FIG. 3.
Figure 7:
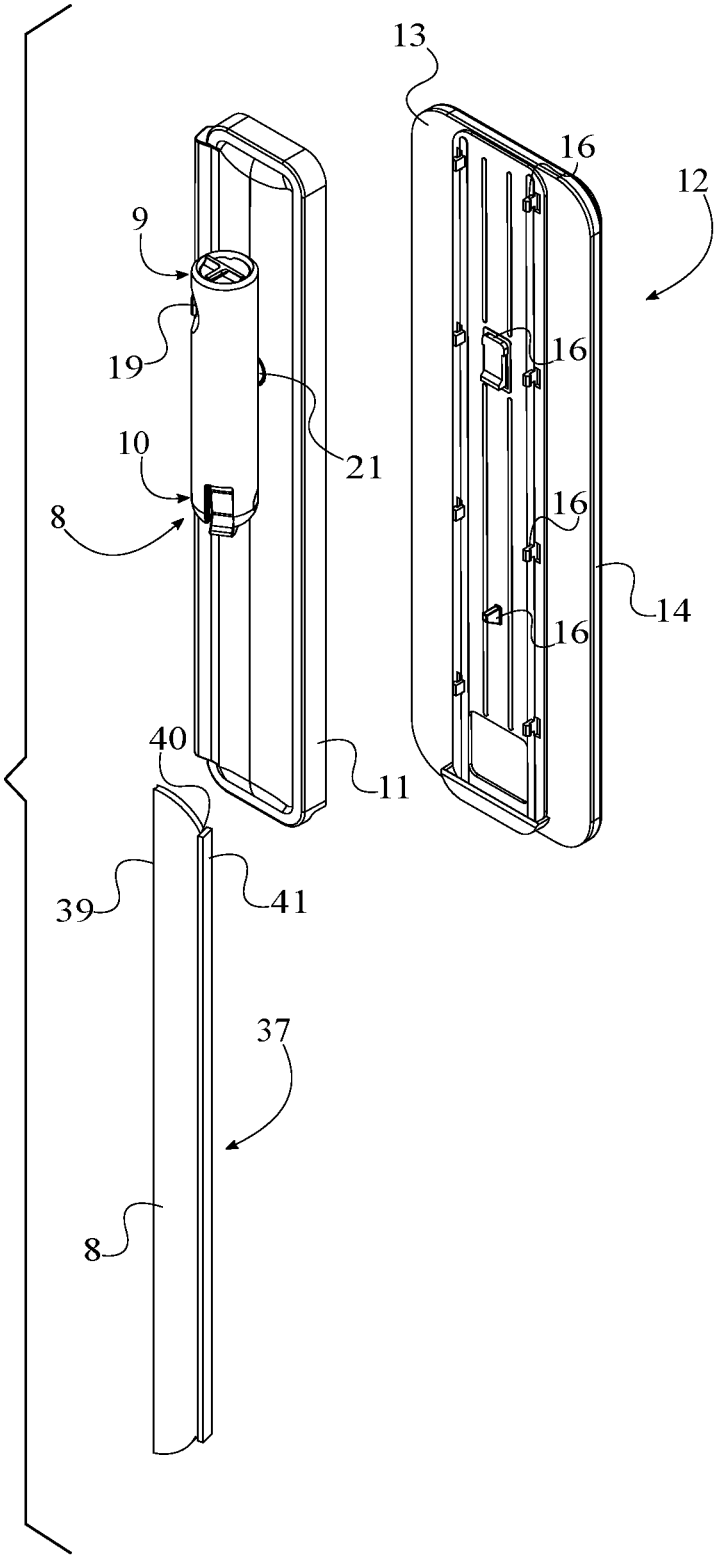
FIG. 7 is a top exploded view of the adapter neck, the retention bracket, and at least one interchangeable head assembly for the present invention.

In order to engage the first attachment mechanism 18, a first release button 19 of the first attachment mechanism 18 is laterally mounted onto the adapter neck 8, seen in FIG. 4 and FIG. 7. The handle shaft 1 is attached and detached within the adapter neck 8 as the first attachment mechanism 18 is operatively integrated between the second shaft end 3 and the open neck end 9, wherein the first release button 19 is used to actuate the first attachment mechanism 18 in order to disengage the second shaft end 3 from the open neck end 9. In order to engage the second attachment mechanism 20, a second release button 21 of the second attachment mechanism 20 is mounted onto retention bracket 11, opposite the base plate 13. The base plate 13 is attached and detached with the retention bracket 11 as the second attachment mechanism 20 is operatively integrated between the retention bracket 11 and the base plate 13, wherein the second release button 21 is used to actuate the second attachment mechanism 20 in order to disengage the base plate 13 from the retention bracket 11.

The mop head 14 of the at least one interchangeable head assembly 12 may be temporarily cleaned throughout the use of the at least one interchangeable head assembly 12 as the present invention may further comprise a wringer mechanism 22, seen in FIG. 1, FIG. 2, FIG. 3, and FIG. 4. The wringer mechanism 22 may comprise a handgrip 23, an elongated brace 24, a housing 25, a mop-receiving channel 26, a shaft-receiving channel 27, a plurality of press rollers 28, and a deployment mechanism 30. The handgrip 23 and the elongated brace 24 wrap around the handle shaft 1. The handgrip 23 provides an area around the wringer mechanism 22 for a user to grasp. The elongated brace 24 connects the handgrip 23 with the housing 25. The housing 25 contains the plurality of press rollers 28 and the deployment mechanism 30. The mop-receiving channel 26 defines a path for the at least one interchangeable head assembly 12, along with the adapter neck 8 and the retention bracket 11, to traverse through the housing 25. The shaft-receiving channel 27 defines a path for the at least one interchangeable head assembly 12, along with the adapter neck 8 and the retention bracket 11, to traverse through the elongated brace 24. The plurality of press rollers 28 presses against the mop head 14 in order to wring the mop head 14. The deployment mechanism 30 extends and retracts the plurality of press rollers 28 against the mop head 14 while positioned within the housing 25.

The arrangement of the aforementioned components of the wringer mechanism 22 allows the at least one interchangeable head assembly 12, along with the adapter neck 8 and the retention bracket 11, to be retracted into and extended out of the housing 25 with the handle shaft 1, seen in FIG. 1, FIG. 2, FIG. 3, FIG. 4, and FIG. 8. In order for the user to grasp the wringer mechanism 22 while pushing and pulling the handle shaft 1 within the elongated brace 24, the handgrip 23 is terminally connected to the elongated brace 24, and the housing 25 is terminally connected to the elongated brace 24, opposite the handgrip 23. In order for the at least one interchangeable head assembly 12, along with the adapter neck 8 and the retention bracket 11, to traverse along the elongated brace 24, the shaft-receiving channel 27 traverses through the housing 25, the elongated brace 24, and the handgrip 23. Similarly, the mop-receiving channel 26 traverses through the housing 25 and is positioned adjacent and parallel to the shaft-receiving channel 27 for the at least one interchangeable head assembly 12 to be positioned within the housing 25. The plurality of press rollers 28 is positioned adjacent to the mop-receiving channel 26, opposite to the shaft-receiving channel 27 in order for the plurality of press rollers 28 to be able to press against the mop head 14. The plurality of press rollers 28 is operatively mounted within the housing 25 by the deployment mechanism 30, wherein the deployment mechanism 30 is used to coincidently align the deployment mechanism 30 along the mop-receiving channel 26 during an operative configuration and is used to retract the plurality of press rollers 28 away from the mop-receiving channel 26 during a collapsed configuration. The user therefore engages the deployment mechanism 30 by sliding the mop head 14 into and out of the housing 25 and through the mop-receiving channel 26 to wring the mop head 14.

In the preferred embodiment of the present invention, the deployment mechanism 30 may further comprise a spring-loaded hinged rack 31 and a fulcrum roller 32, seen in FIG. 4. The spring-loaded hinged rack 31 positions and orients the plurality of press rollers 28, and the fulcrum roller 32 actuates the spring-loaded hinged rack 31. In order for the plurality of press rollers 28 to be engaged, the plurality of press rollers 28 is distributed along the spring-loaded hinged rack 31. The mop head 14 of the at least one interchangeable head assembly 12 is thoroughly wrung as each of the plurality of press rollers 28 is rotatably mounted to the spring-loaded hinged rack 31. The fulcrum roller 32 is terminally positioned adjacent to the mop-receiving channel 26, adjacent to the elongated brace 24. More specifically, the fulcrum roller 32 is rotatably mounted to the housing 25. This arrangement requires minimal force by the user to engage the fulcrum roller 32 with the mop head 14 while grasping the handgrip 23. The spring-loaded hinged rack 31 is torsionally connected to the fulcrum roller 32 in order for the plurality of press rollers 28 to effectively press against the mop head 14. The fulcrum roller 32 is operatively coupled to the mop head 14, wherein an engagement between the fulcrum roller 32 and the mop head 14 is used to pivot the spring-loaded hinged rack 31 and to move the plurality of press rollers 28 into the operative configuration. Furthermore, a disengagement between the fulcrum roller 32 and the mop head 14 is used to recoil the spring-loaded hinged rack 31 and to move the plurality of press rollers 28 into the collapsed configuration. The plurality of press rollers 28 therefore automatically retracts after the mop head 14 is pushed out of the housing 25.

In order for the plurality of press rollers 28 to thoroughly wring the mop head 14, a rotation axis 29 for each of the plurality of press rollers 28 and a rotation axis 42 for the fulcrum roller are positioned parallel and offset from each other, also seen in FIG. 4. The plurality of press rollers 28 smoothly roll along the mop head 14 as the rotation axis 29 for each of the plurality of press rollers 28 and the rotation axis 42 for the fulcrum roller are positioned perpendicular to the mop-receiving channel 26.

Figure 5:
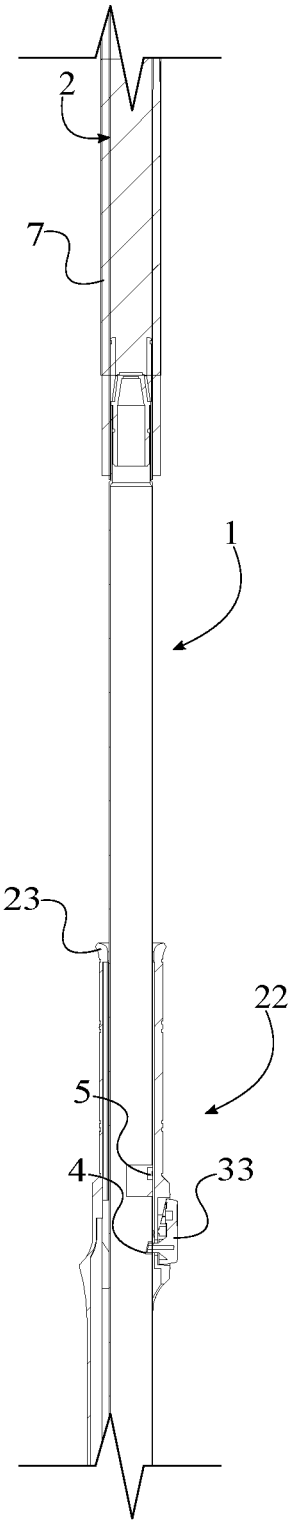
FIG. 5 is a top portion cross-section view taken along line 4-4 in FIG. 3.

In the preferred embodiment of the present invention, the position of the wringer mechanism 22 may be fixed along the handle shaft 1. In order to secure the wringer mechanism 22 with the handle shaft 1, the wringer mechanism 22 may further comprise a pin-lock button 33, seen in FIG. 1, FIG. 2, and FIG. 5. The handle shaft 1 further comprises a first notch 4 and a second notch 5, seen in FIG. 5. The first notch 4 and the second notch 5 allow the pin-lock button 33 to secure a position of the wringer mechanism 22 along the handle shaft 1. A user is able to easily engage the pin-lock button 33 as the pin-lock button 33 laterally is laterally mounted onto the elongated brace 24. The first notch 4 and the second notch 5 are laterally traversing into the elongated brace 24, preserving the structural integrity of the handle shaft 1 while allowing the pin-lock button 33 to lock into the handle shaft 1. The pin-lock button 33 is quickly accessed by the user as the first notch 4 and the second notch 5 are positioned offset with the first shaft end 2. More specifically, the first notch 4 is positioned offset with the second notch 5, and the second notch 5 is positioned in between the first notch 4 and the first shaft end 2. In order for the wringer mechanism 22 to remain secured with the handle shaft 1 while the mop head 14 is being used, the first notch 4 is engaged by the pin-lock button 33, and the mop head 14 is positioned outside the mop-receiving channel 26. In order for mop head 14 to remain positioned within the housing 25 while being wrung, the second notch 5 is engaged by the pin-lock button 33, and the mop head 14 is positioned inside the mop-receiving channel 26.

Figure 8:
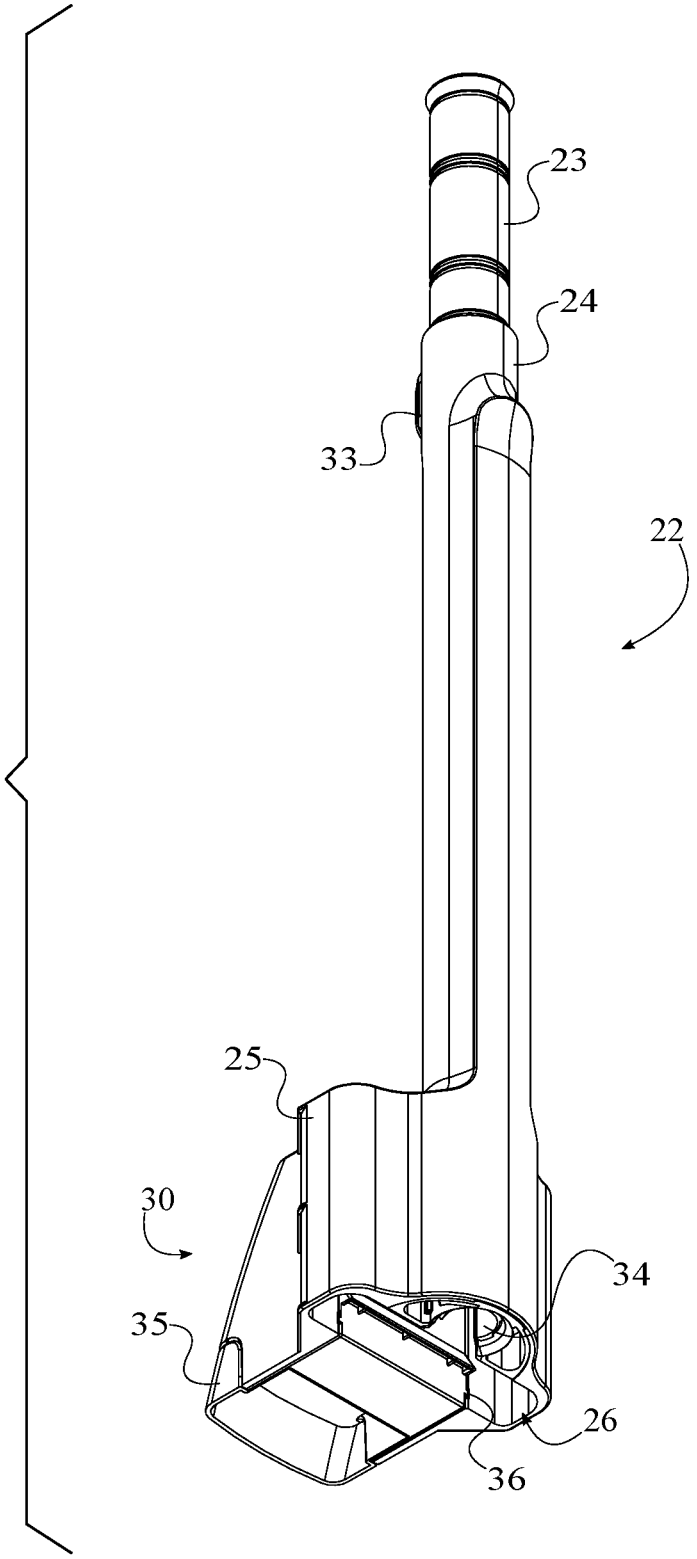
FIG. 8 is a rear perspective view of a wringer mechanism of the present invention.

Furthermore, for the preferred embodiment of the present invention, the wringer mechanism 22 may further comprise a neck-receiving slot 34, seen in FIG. 8. The neck-receiving slot 34 specifically provides a path along the elongated brace 24 for the adapter neck 8. In order for the mop head 14 to continuously and freely slide along the elongated brace 24, the neck-receiving slot 34 traverses through the housing 25 and into the elongated brace 24. More specifically, the neck-receiving slot 34 is positioned along the shaft-receiving channel 27. The shaft-receiving channel 27 is intersected by the neck-receiving slot 34, thereby accommodating the arrangement of the adapter neck 8 with that of the retention brace and the at least one interchangeable head assembly 12.

Depending on the type of mop head 14 of the at least one interchangeable head assembly 12, the present invention may further comprise a lint scraper 35 and a scraper sliding mechanism 36, seen in FIG. 1, FIG. 2, FIG. 4, and FIG. 8. The lint scraper 35 removes any attached fibrous material or hairs that are attached with the mop head 14 and preferably cleans a mop head 14 with fabric material. The scraper sliding mechanism 36 engages and disengages the lint scraper 35 with the mop head 14. The lint scraper 35 is terminally positioned to the mop-receiving channel 26, adjacent to the elongated brace 24, so that the lint scraper 35 comes into contact with the mop head 14 upon entering and exiting the housing 25. The lint scraper 35 is operatively mounted into the housing 25 by the scraper sliding mechanism 36, wherein the lint scraper 35 is used to coincidently align the lint scraper into the mop-receiving channel 26 during an engagement configuration and used to retract the lint scraper 35 away from the mop-receiving channel 26 during a disengagement configuration. As the mop head 14 slides across the lint scraper 35, the lint scraper 35 frictionally engages with the mop head 14 to remove any fibrous material or hairs as the lint scraper 35 is mounted to the housing 25.

In the preferred embodiment of the present invention, the handle shaft 1 further may comprise an eyelet 6 and a handle grip 7, seen in FIG. 1, FIG. 2, FIG. 3, and FIG. 5. The handle shaft 1 may be hung with the eyelet 6 for easy storage. The handle grip 7 provides a comfortable area along the handle shaft 1 for a user to grip. The present invention is suspended by the eyelet 6 as the eyelet 6 is fixed adjacent with the first shaft end 2, positioning the at least one interchangeable head assembly 12 towards the ground. The handle grip 7 is laterally fixed around the handle shaft 1 and is positioned adjacent with the first shaft end 2, as the first shaft end 2 is the portion of the handle shaft 1 that the user grasps in order to maneuver the at least one interchangeable head assembly 12.

Figure 6:
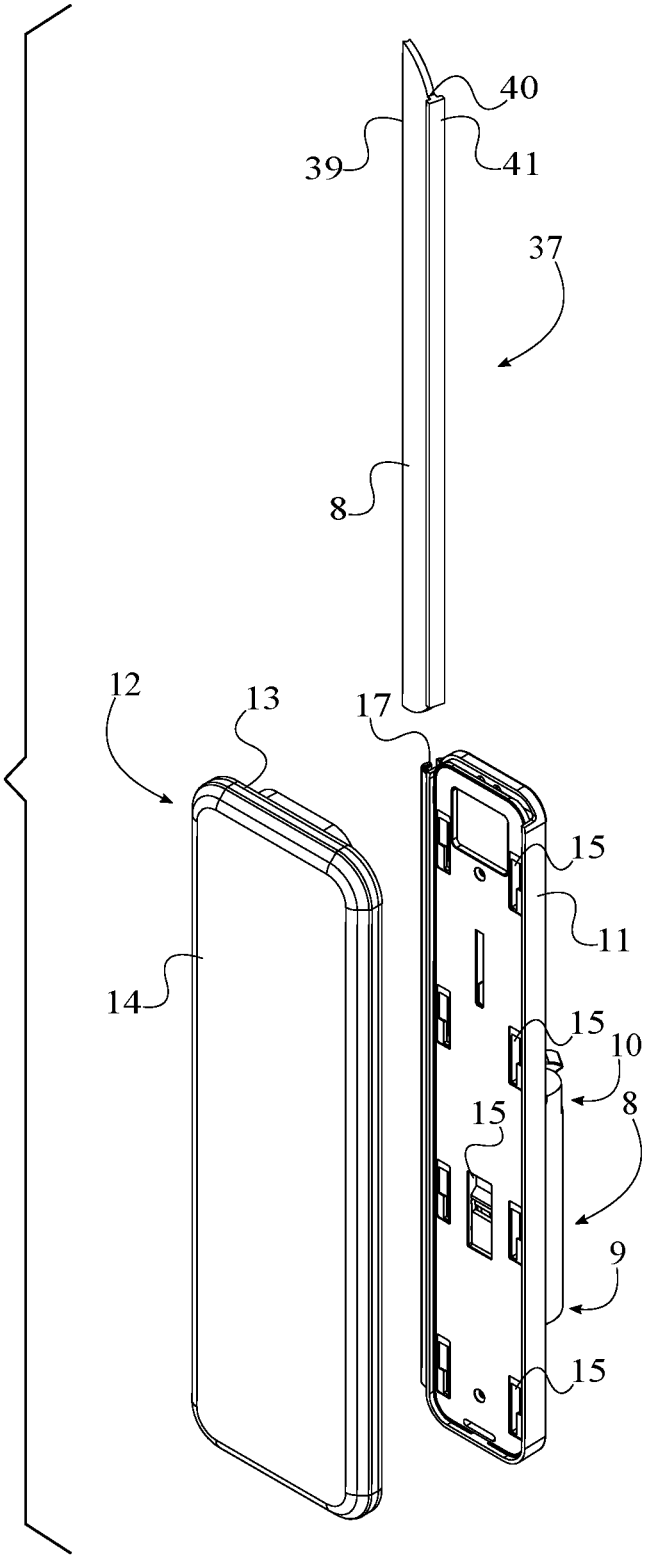
FIG. 6 is a bottom exploded view of an adapter neck, a retention bracket, and at least one interchangeable head assembly for the present invention.

In the preferred embodiment of the present invention, the at least one interchangeable head assembly 12 may further comprise a plurality of sockets 15 and a plurality of hooks 16, seen in FIG. 4, FIG. 6, and FIG. 7. The plurality of sockets 15 receives and engages the plurality of hooks 16 so that the base plate 13 is secured with the retention bracket 11. More specifically, the plurality of sockets 15 is distributed across the retention bracket 11 and traverses into the retention bracket 11, opposite the adapter neck 8. In order for the base plate 13 to connect with the retention bracket 11, the plurality of hooks 16 is distributed across the base plate 13 and is fixed onto the base plate 13, opposite the mop head 14. The base plate 13 is superimposed across the retention bracket 11 as each of the plurality of hooks 16 is positioned into a corresponding socket from the plurality of sockets 15. The plurality of hooks 16 is operatively coupled to the second locking mechanism, wherein the second attachment mechanism 20 is used to hold in place each of the plurality of hooks 16 within the corresponding socket and is used to release each of the plurality of hooks 16 out of the corresponding socket, thereby allowing the at least one interchangeable head assembly 12 to be easily interchanged.

In the preferred embodiment of the present invention, the present invention may further comprise a squeegee 37, seen in FIG. 1, FIG. 2, FIG. 3, FIG. 6, and FIG. 7. The squeegee 37 removes or moves liquid on a surface. The at least one interchangeable head assembly 12 may further comprise a retention groove 17, which receives the squeegee 37. The squeegee 37 comprises an elongated body 38, a first lengthwise edge 39, a second lengthwise edge 40, and an elongated tab 41. The elongated body 38 collects liquid that has been pushed by the first lengthwise edge 39. In order to collect any liquid, the elongated body 38 tapers from the second lengthwise edge 40 to the first lengthwise edge 39. The retention groove 17 is peripherally integrated along the retention bracket 11 so that the mop head 14 may freely press against a surface while the squeegee 37 is connected with the retention bracket 11. The squeegee 37 may remove or move liquid on a surface while attached with the retention bracket 11 as the first lengthwise edge 39 is positioned opposite the second lengthwise edge 40 about the elongated body 38. More specifically, the elongated tab 41 is positioned adjacent with the second lengthwise edge 40 and is fixed along the second lengthwise edge 40. The elongated tab 41 is slidably engaged into the retention groove 17, thereby facilitating the attachment and detachment of the squeegee 37 as needed. The squeegee 37 is easily maneuvered along with the at least one interchangeable mop head 14 assembly as the elongated body 38 is positioned parallel with the base plate 13.

Although the invention has been explained in relation to its preferred embodiment, it is to be understood that many other possible modifications and variations can be made without departing from the spirit and scope of the invention as hereinafter claimed.

What is claimed is:

1. A mop with interchangeable head mechanisms comprises:

a handle shaft;
an adapter neck;
a retention bracket;
at least one interchangeable head assembly;
a first attachment mechanism;
a second attachment mechanism;
a lint scraper;
a scraper sliding mechanism;

the handle shaft comprises a first shaft end and a second shaft end;

the adapter neck comprises an open neck end and a closed neck end;

the at least one interchangeable head assembly comprises a base plate and a mop head;

the first shaft end being positioned opposite the second shaft end along the handle shaft;

the retention bracket being positioned adjacent with the closed neck end;

the retention bracket being hingedly connected with the closed neck end;

the second shaft end being releasably mounted into the open neck end by the first attachment mechanism;

the base plate being positioned adjacent with the retention bracket, opposite the adapter neck;

the base plate being releasably mounted across the retention bracket by the second attachment mechanism;

the mop head being positioned adjacent with the base plate, opposite the retention bracket;

the mop head being mounted across the base plate;

a wringer mechanism;

the wringer mechanism comprises a handgrip, an elongated brace, a housing, a mop-receiving channel, a shaft-receiving channel, a plurality of press rollers, and a deployment mechanism;

the handgrip being terminally connected to the elongated brace;

the housing being terminally connected to the elongated brace, opposite the handgrip;

the shaft-receiving channel traversing through the housing, the elongated brace, and the handgrip;

the mop-receiving channel traversing through the housing;

the mop-receiving channel being positioned adjacent and parallel to the shaft-receiving channel;

the plurality of press rollers being positioned adjacent to the mop-receiving channel, opposite to the shaft-receiving channel;

the plurality of press rollers being operatively mounted within the housing by the deployment mechanism, wherein the deployment mechanism is used to coincidently align the plurality of press rollers along the mop-receiving channel during an operative configuration and is used to retract the plurality of press rollers away from the mop-receiving channel during a collapsed configuration, wherein the plurality of press rollers are kept positioned within the housing when the plurality of press rollers are moved from the operative configuration to the collapsed configuration and from the collapsed configuration to the operative configuration;

the lint scraper being terminally positioned to the mop-receiving channel, opposite to the elongated brace;

the lint scraper being operatively mounted into the housing by the scraper sliding mechanism;

the scraper sliding mechanism engaging and disengaging the lint scraper with the mop head, wherein the lint scraper is used to coincidently align the lint scraper into the mop-receiving channel during an engagement configuration and used to retract the lint scraper away from the mop-receiving channel during a disengagement configuration.

2. The mop with interchangeable head mechanisms as claimed in claim 1 comprises:

a first release button of the first attachment mechanism being laterally mounted onto the adapter neck; and, the first attachment mechanism being operatively integrated between the second shaft end and the open neck end, wherein the first release button is used to actuate the first attachment mechanism in order to disengage the second shaft end from the open neck end.

3. The mop with interchangeable head mechanisms as claimed in claim 1 comprises:

a second release button of the second attachment mechanism being mounted onto the retention bracket, opposite the base plate; and, the second attachment mechanism being operatively integrated between the retention bracket and the base plate, wherein the second release button is used to actuate the second attachment mechanism in order to disengage the base plate from the retention bracket.

4. The mop with interchangeable head mechanisms as claimed in claim 1 comprises:

the deployment mechanism comprises a spring-loaded hinged rack and a fulcrum roller;

the plurality of press rollers being distributed along the spring-loaded hinged rack;

the plurality of press rollers being rotatably mounted to the spring-loaded hinged rack;

the fulcrum roller being terminally positioned to the mop-receiving channel, adjacent to the elongated brace;

the fulcrum roller being rotatably mounted to the housing;

the spring-loaded hinged rack being torsionally connected to the fulcrum roller; and, the fulcrum roller being operatively coupled to the mop head, wherein an engagement between the fulcrum roller and the mop head is used to pivot the spring-loaded hinged rack and to move the plurality of press rollers into the operative configuration, and wherein a disengagement between the fulcrum roller and the mop head is used to recoil spring-loaded hinged rack and to move the plurality of press rollers into the collapsed configuration.

5. The mop with interchangeable head mechanisms as claimed in claim 4 comprises:

a rotation axis for each of the plurality of press rollers and a rotation axis for the fulcrum roller being positioned parallel to each other; and, the rotation axis for each of the plurality of press rollers and the rotation axis for the fulcrum roller being positioned perpendicular to the mop-receiving channel.

6. The mop with interchangeable head mechanisms as claimed in claim 1 comprises:

the wringer mechanism further comprises a pin-lock button;

the handle shaft further comprises a first notch and a second notch;

the pin-lock button being laterally mounted onto the elongated brace;

the first notch and the second notch laterally traversing into the elongated brace;

the first notch and the second notch being positioned offset with the first shaft end;

the first notch being positioned offset with the second notch; and, the second notch being positioned in between the first notch and the first shaft end.

7. The mop with interchangeable head mechanisms as claimed in claim 6 comprises:

the first notch being engaged by the pin-lock button; and, the mop head being positioned outside the mop-receiving channel.

8. The mop with interchangeable head mechanisms as claimed in claim 6 comprises:

the second notch being engaged by the pin-lock button; and, the mop head being positioned inside the mop-receiving channel.

9. The mop with interchangeable head mechanisms as claimed in claim 1 comprises:

the wringer mechanism further comprises a neck-receiving slot;

the neck-receiving slot traversing through the housing and into the elongated brace;

the neck-receiving slot being positioned along the shaft-receiving channel;

and, the shaft-receiving channel being intersected by the neck-receiving slot.

10. The mop with interchangeable head mechanisms as claimed in claim 1 comprises:

the handle shaft further comprises an eyelet and a handle grip;

the eyelet being fixed adjacent with the first shaft end;

the handle grip being laterally fixed around the handle shaft; and, the handle grip being positioned adjacent with the first shaft end.

11. The mop with interchangeable head mechanisms as claimed in claim 1 comprises:

the at least one interchangeable head assembly further comprises a plurality of sockets and a plurality of hooks;

the plurality of sockets being distributed across the retention bracket;

the plurality of sockets traversing into the retention bracket, opposite the adapter neck;

the plurality of hooks being distributed across the base plate;

the plurality of hooks being fixed onto the base plate, opposite the mop head;

each of the plurality of hooks being positioned into a corresponding socket from the plurality of sockets; and, the plurality of hooks being operatively coupled to the second locking mechanism, wherein the second attachment mechanism is used to hold in place each of the plurality of hooks within the corresponding socket and is used to release each of the plurality of hooks out of the corresponding socket.

12. The mop with interchangeable head mechanisms as claimed in claim 1 comprises:

a squeegee;

the at least one interchangeable head assembly further comprises a retention groove;

the squeegee comprises an elongated body, a first lengthwise edge, a second lengthwise edge, and an elongated tab;

the retention groove being peripherally integrated along the retention bracket;

the first lengthwise edge being positioned opposite the second lengthwise edge about the elongated body;

the elongated tab being positioned adjacent with the second lengthwise edge;

the elongated tab being fixed along the second lengthwise edge;

the elongated tab being slidably engaged into the retention groove; and, the elongated body being positioned parallel with the base plate.

13. The mop with interchangeable head mechanisms as claimed in claim 12, wherein the elongated body tapers from the second lengthwise edge to the first lengthwise edge.

* * * * *